US006070879A

United States Patent [19]

Kemp

[11] Patent Number: 6,070,879

[45] Date of Patent: Jun. 6, 2000

[54] GOALS FOR GAMES

[76] Inventor: Kelvin P. Kemp, 535 Bungalow Dr., El Segundo, Calif. 90245

[21] Appl. No.: 09/079,961

[22] Filed: May 15, 1998

[51] Int. Cl.[7] ..... A63F 7/22

[52] U.S. Cl. ..... 273/317.5; 273/108.4; 273/127 R

[58] Field of Search ..... 273/108.1, 108.4, 273/317.1, 317.5, 127 R; 473/470, 476, 477; D21/357, 699, 788

[56] References Cited

U.S. PATENT DOCUMENTS

| | | | |
|---|---|---|---|
| D. 250,283 | 11/1978 | Norton | D21/699 |
| 1,929,757 | 10/1933 | Sargent | 273/317.5 |
| 3,908,992 | 9/1975 | Cunningham et al. | 473/477 |
| 4,927,145 | 5/1990 | Davis | 273/317.5 |
| 5,249,796 | 10/1993 | Silvi | 273/127 R X |
| 5,494,284 | 2/1996 | Wray, Jr. | 273/108.4 |
| 5,584,480 | 12/1996 | Grimsrud | 473/477 X |

*Primary Examiner*—Raleigh W. Chiu

*Attorney, Agent, or Firm*—Lee W. Tower

[57] ABSTRACT

Goals for games are provided. A crosspiece for a game goal is provided that can be used for both rugby and football. A first gripper is provided on a first end of the crosspiece for retaining a flexible pole on the first end of the crosspiece. The first gripper has a first opening having an entry side and an exit side, and the first opening is tapered between the entry side and the exit side. A second gripper is provided on a second end of the crosspiece for retaining a flexible pole on the second end of the crosspiece. The second gripper has a first opening having an entry side and an exit side, and the first opening is tapered between the entry side and the exit side. A center gripper is provided in the center of the crosspiece for retaining a flexible pole on the center of the crosspiece. The center gripper has a hole having an entry side and the hole extends to a bottom wall. The hole is tapered between the entry side and the bottom wall. By combining the crosspiece with flexible poles made of foam rubber and a base, rugby and football goals are provided. Other goals for basketball and soccer type games are constructed in a similar manner.

4 Claims, 4 Drawing Sheets

GOALS FOR GAMES

BACKGROUND OF THE INVENTION

1. Field of the Invention

This invention relates to game goals and more particularly to game goals for miniature game versions of rugby, football, basketball, and soccer type games, which include games such as soccer, ice hockey, roller hockey, field hockey, team handball, water polo, and lacrosse.

2. Description of the Related Art

Games played by teams of players on large out-of-door and in-door fields, such as rugby, football, basketball, and soccer type games, including soccer, ice hockey, roller hockey, field hockey, team handball, water polo and lacrosse, have long been the subject of miniaturization so that one or two players can play a simulation of the game at home, such as on a table top or on the floor.

One such game is described in U.S. Pat. No. 4,733,867 issued to Kelvin P. Kemp Mar. 29, 1988 for a Finger Football/Finger Rugby Game, incorporated herein by reference as though set forth in full.

What are needed for these games are goal posts that can be easily disassembled for storage. The components should be capable for use for multiple types of goals, such as for football and rugby. Also the goals should be safe for use by children. In particular, certain components of the goals should be made of soft, flexible materials, so that even if a child falls on the goals no damage to the child's eyes or other easily damaged portions of the body will occur.

SUMMARY OF THE INVENTION

It is an object of this invention to provide game goals that are easily assembled and disassembled, have common components for multiple games, and are safe for children.

According to one embodiment of the invention, a crosspiece for a game goal is provided that can be used for both rugby and football. A first gripper is provided on a first end of the crosspiece for retaining a flexible pole on the first end of the crosspiece. The first gripper has a first opening having an entry side and an exit side, and the first opening is tapered between the entry side and the exit side. A second gripper is provided on a second end of the crosspiece for retaining a flexible pole on the second end of the crosspiece. The second gripper has a first opening having an entry side and an exit side, and the first opening is tapered between the entry side and the exit side. A center gripper is provided in the center of the crosspiece for retaining a flexible pole on the center of the crosspiece. The center gripper has a hole having an entry side and the hole extends to a bottom wall. The hole is tapered between the entry side and the bottom wall.

In another embodiment of the invention, a rugby goal is provided. A base includes a first retainer and a second retainer for retaining inserted flexible poles. The first retainer includes a first cylindrical wall attached to and rising from the base and the second retainer includes a second cylindrical wall attached to and rising from the base. A first flexible pole is inserted through the first opening of the crosspiece summarized above and extends beyond both the entry side and the exit side of the first opening. A second flexible pole is inserted through the second opening and extends beyond both the entry side and the exit side of the second opening. The first pole is then inserted into the first retainer and the second pole is inserted into the second retainer.

In another embodiment a soccer type goal is provided using the base with two retainers. A flexible pole having a first end and a second end and having two right angle bends between the first end and the second end is inserted into the two retainers on the base. A spreader for retaining the shape of a net is attached to the two retainers on the base. A net for the soccer type goal is retained by the flexible pole and the spreader.

The base includes a first flat section extending in front of the first retainer and the second retainer. The first flat section is adapted to be positioned under a playing field. A second section of the base extends beyond the playing field and includes a second flat section extending behind the first retainer and the second retainer.

In another embodiment a football goal is provided. A base includes a retainer for retaining a flexible pole. A first flexible pole is inserted into the retainer. The retainer includes a cylindrical wall attached to and rising from the base. The crosspiece summarized above is used. The first flexible pole is inserted into the center gripper of the crosspiece. Then a second flexible pole is inserted into the first opening on the first end of the crosspiece so that the second flexible pole extends away from the base. Also a third flexible pole is inserted into the second opening on the second end of the crosspiece so that the third flexible pole extends away from the base. The base includes a flat section extending in front of the retainer. The flat section is adapted to be positioned under a playing field. A second section of the base extends beyond the playing field.

In another embodiment, the base with one retainer is used to provide a basketball goal. An article having a first end and a second end is provided. A gripper is included on the first end of the article, the gripper having an opening having an entry side and an exit side and adapted for gripping an inserted flexible pole. A basket is included on the second end of the article. A flexible pole is inserted through the opening on the gripper extending beyond both the entry side and the exit side of the opening. The flexible pole is also inserted into the retainer on the base. A backboard is mounted on the article between the first end and the second end.

Other objects and many of the attendant features of this invention will be more readily appreciated as the same becomes better understood by reference to the following detailed descriptions and considered in connection with the accompanying drawings in which like reference symbols designate like parts throughout the figures.

DETAILED DESCRIPTION

Figure 1:
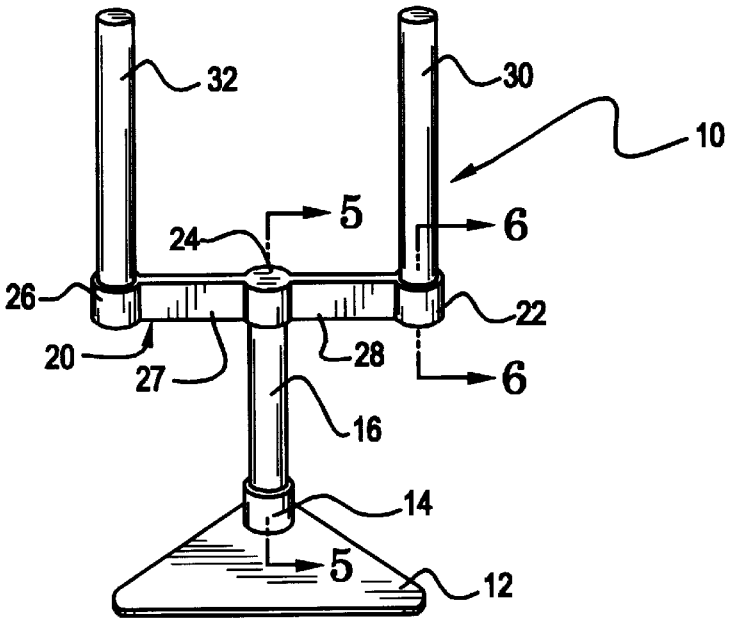
FIG. 1 illustrates a football goal constructed in accordance with the present invention.

Referring now to the drawings, and more particularly, to FIG. 1, a football goal 10 is shown. The football goal 10 has a base 12, which is shown as a triangular shape, although the base can be rectangular or any other shape. The base 12 has an integral retainer 14, which is cylindrical in shape. The integral base and retainer can be made of plastic.

Figure 5:
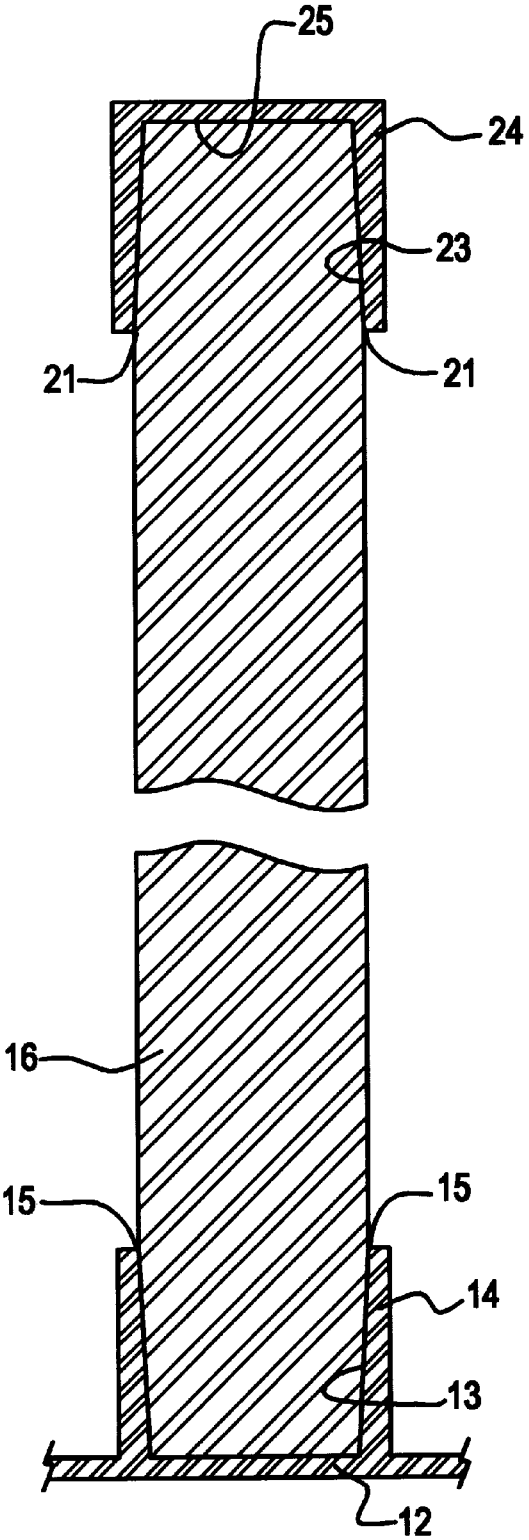
FIG. 5 is a sectional view of a portion of the goal along line 5—5 of FIG. 1 in accordance with the present invention.

A flexible post 16 is inserted into retainer 14. FIG. 5 shows a detailed sectional view of flexible post 16 inserted through opening 15 into retainer 14. The interior surface 13 of retainer 14 is tapered from the opening 15 to the base 12 in order to firmly grip the inserted flexible post 16. The taper increases the friction on the inserted flexible post 16. The flexible post 16 can be made of foam rubber.

The other end of flexible post 16 is inserted into gripper 24 in the center of crosspiece 20. The crosspiece 20 is a unitary piece and can be made of plastic. The gripper 24 is shown in detail in the sectional view of FIG. 5. The interior surface 23 of gripper 24 is tapered from the opening 21 to the bottom wall 25 in order to firmly grip the inserted flexible post 16.

In addition to the gripper 24 in the center of the crosspiece 20, the crosspiece has gripper 22 on one end and gripper 26 on the other end. Grippers 22 and 26 are identical in design. The thickness of the crosspiece between gripper 22 and gripper 24 and between gripper 24 and gripper 26 is less than the thickness at grippers 22, 24, and 26.

Figure 6:
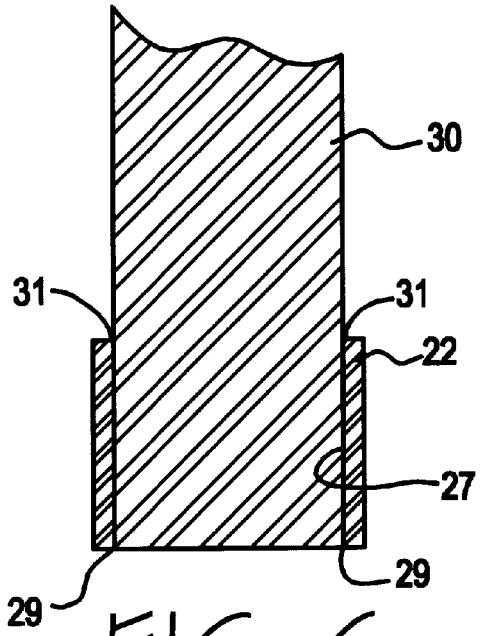
FIG. 6 is a sectional view of a portion of the goal along line 6—6 of FIG. 1 in accordance with the present invention.

FIG. 6 shows a detailed sectional view of gripper 22. Gripper 22 is cylindrical in shape and has an opening extending from opening end 29 to opening end 31. The interior wall 27 of the gripper 22 is tapered from opening end 29 to opening end 31 in order to firmly grip an inserted flexible post. As shown in FIGS. 1 and 6, flexible post 30 is inserted through the opening of gripper 22 so that the flexible post extends away from base 12. In a similar manner, as shown in FIGS. 1 and 6, flexible post 32 is inserted through the opening of gripper 26 so that the flexible post extends away from base 12. The flexible posts 30 and 32 can be made from foam rubber. The result is a football goal which is easy to assemble and disassemble and is safe for use by children.

Figure 3:
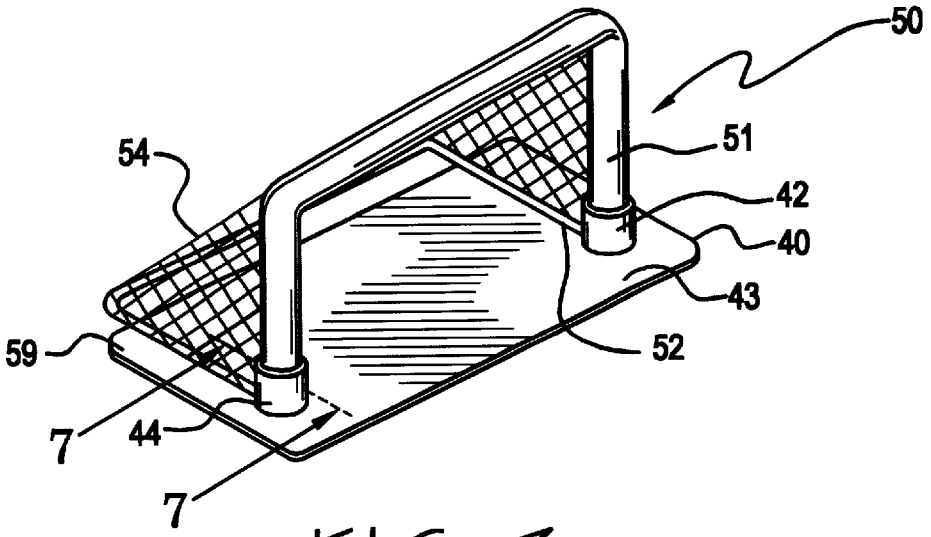
FIG. 3 illustrates a soccer type goal constructed in accordance with the present invention.
Figure 8:
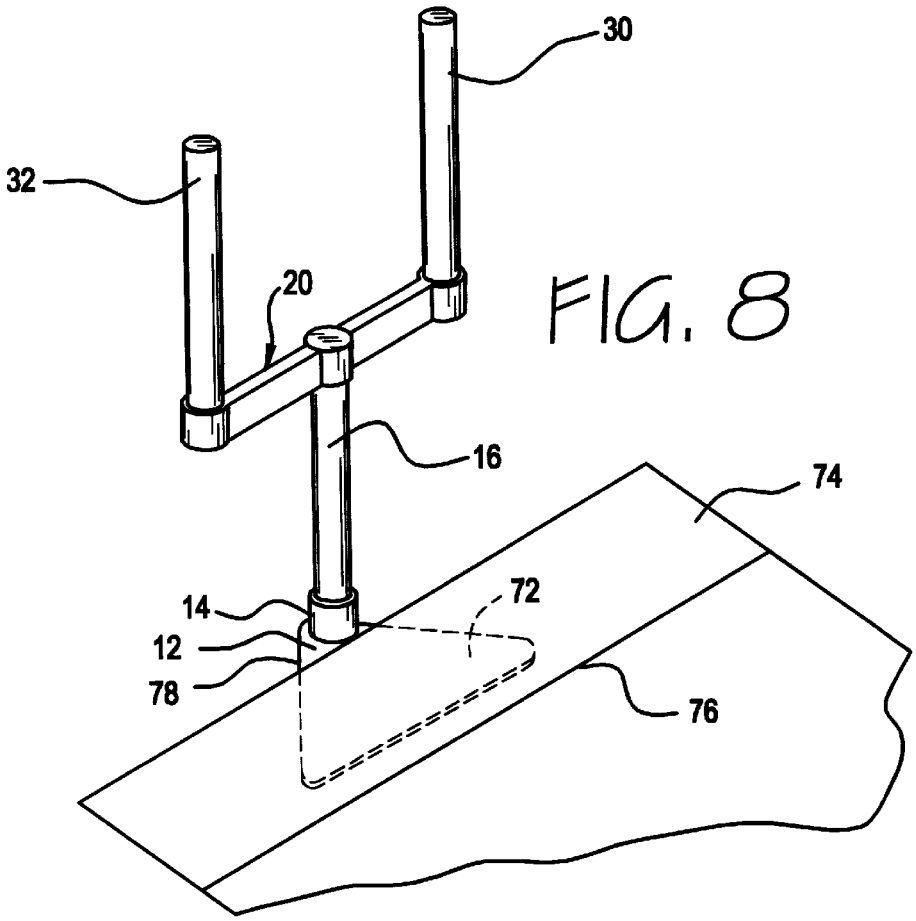
FIG. 8 shows a flat section of the base of the football game goal placed under a playing field in accordance with the present invention.

As shown in FIG. 8, the football goal can be placed under a playing field 74, which can be a rug or other playing surface. The playing field may have a set of boundary lines 76. Typically a goal is placed at each end of the playing field as illustrated in FIG. 3 of U.S. Pat. No. 4,733,867. A flat section 72 of the base 12 extends in front of retainer 14 and is placed under the playing field 74, which helps to hold the game goal in place. A section 78 of the base 12 extends beyond the playing field, which provides stability for the goal. As discussed below with respect to FIG. 4, the same base 12 can be used for a basketball goal. In that case the flat section 72 can also be placed under a playing field.

Figure 2:
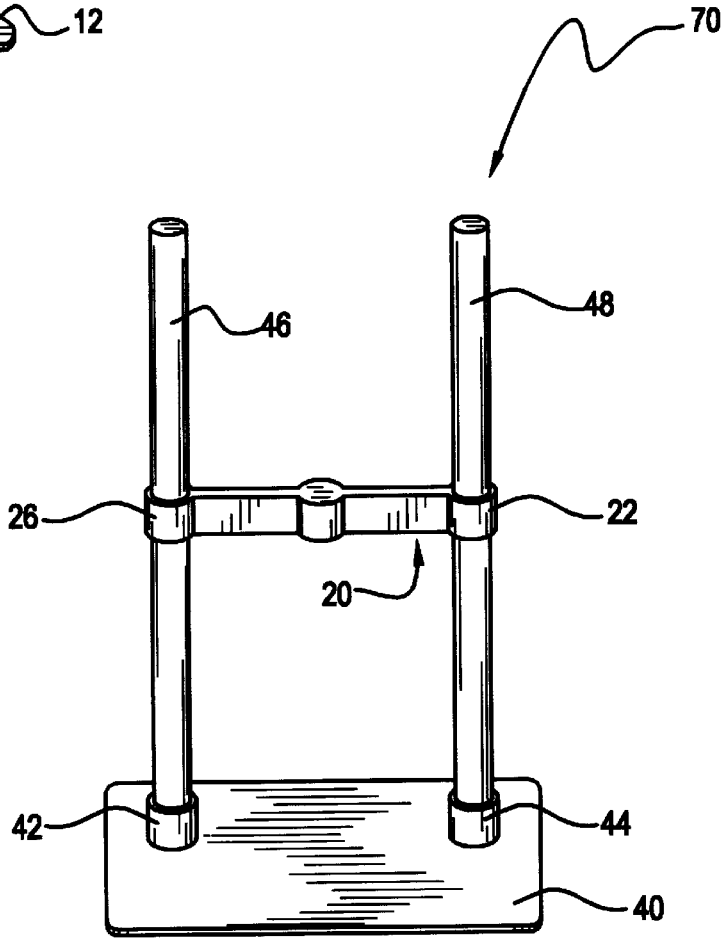
FIG. 2 illustrates a rugby goal constructed in accordance with the present invention.

FIG. 2 shows a rugby goal 70. The rugby goal 70 has a base 40, which is shown as a rectangular shape, although the base can be triangular or any other shape. The base 40 includes integral retainers 42 and 44, which are cylindrical in shape. The integral base and retainers can be made of plastic.

A flexible post 46 is inserted into retainer 42. The interior surface of retainer 42 is tapered from the opening to the base 40, in the same manner as shown in FIG. 5 for retainer 14, in order to firmly grip the inserted flexible post 46. The taper increases the friction on the inserted flexible post 46. A flexible post 48 is inserted into retainer 44 and held in retainer 44 in a similar manner. The flexible posts 46 and 48 are of equal length and can be made of foam rubber.

The flexible post 46 is also inserted through the opening of gripper 26 on crosspiece 20. To form a rugby goal the crosspiece is positioned so that approximately one-third of the flexible pole 46 is between the crosspiece and the base 40. Also, as shown in FIG. 2, the flexible post 48 is inserted through the opening of gripper 22 on the crosspiece 20, which is positioned along flexible pole 48 so that the crosspiece is essentially parallel to the base 40. The tapered openings of grippers 22 and 26 firmly grip the flexible posts and prevent the crosspiece from slipping down the flexible posts 46 and 48.

For the rugby goal the gripper 24 is not needed; however, the same crosspiece is used for both the football goal and the rugby goal, which reduces the cost of the goals.

FIG. 3 shows a soccer type goal 50. The soccer type goal 50 uses the same base 40 as used for the rugby goal, and includes integral retainers 42 and 44. A flexible post 51 having two right angle bends and two ends, has one end inserted into retainer 42 and the other end inserted into retainer 44. The tapered interior surfaces of retainers 42 and 44 grip the inserted flexible post 51, in the same manner as shown in FIG. 5 for retainer 14.

Figure 7:
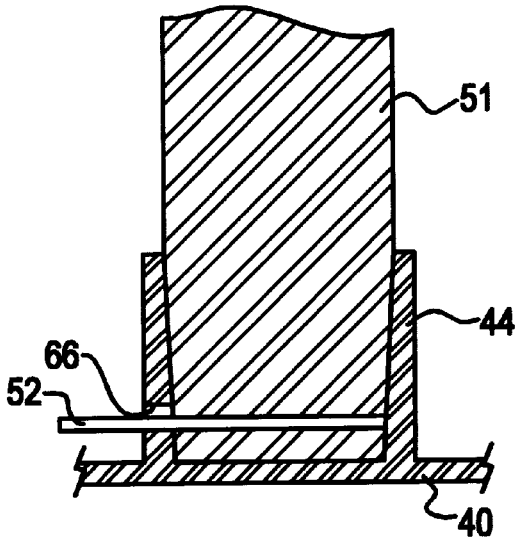
FIG. 7 is a sectional view of a portion of the goal along line 7—7 of FIG. 3 in accordance with the present invention.

FIG. 7 shows a detailed sectional view of flexible post 51 inserted into retainer 44. Retainer 44 has a hole 66, shown in FIG. 7. A spreader 52, which can be made of plastic or wire is inserted into the hole and through a portion of the flexible pole 51. The purpose of the spreader 51, as shown in FIG. 3, is to spread the net 54. The net 54 is held on the spreader 52 and the flexible pole 51 by threading the spreader 52 and the flexible pole 51 through a portion of the net 54.

Figure 9:
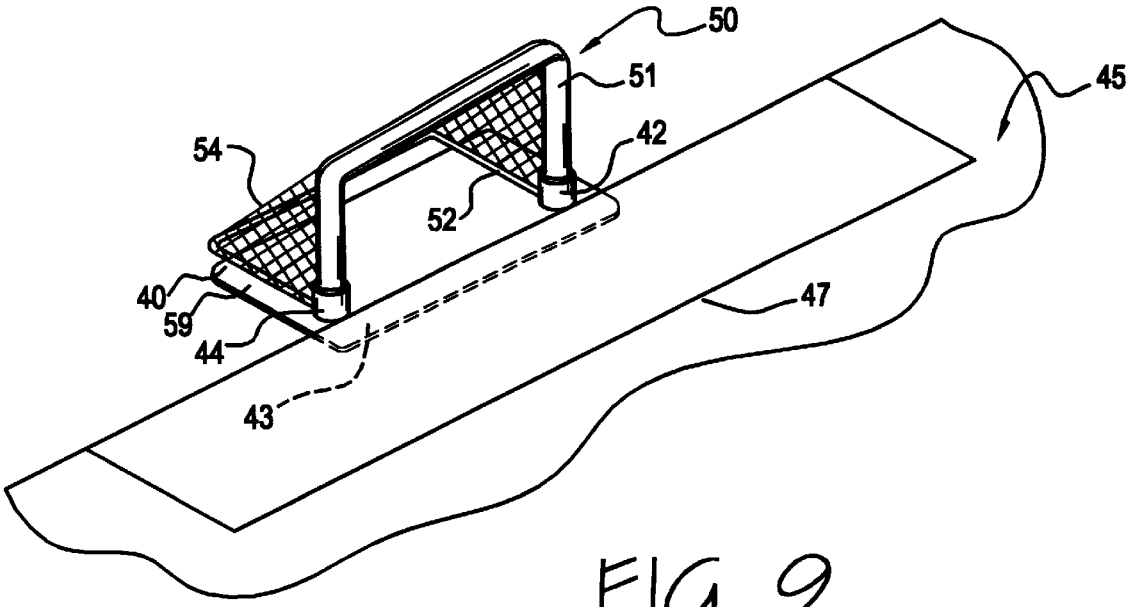
FIG. 9 shows a flat section of the base of the soccer game goal placed under a playing field in accordance with the present invention.

As shown in FIG. 9, the soccer goal can be placed under a playing field 45, which can be a rug or other playing surface. The playing field may have a set of boundary lines 47. Typically a goal is placed at each end of the playing field as illustrated in FIG. 3 of U.S. Pat. No. 4,733,867. A first flat section 43 of the base 40 extends in front of retainers 42 and 44 and is placed under the playing field 45. This helps to hold the game goal in place. A section of the base 40 extends beyond the playing field, including a second flat section 59 that extends behind the retainers 42 and 44 and provides stability for the goal.

Figure 4:
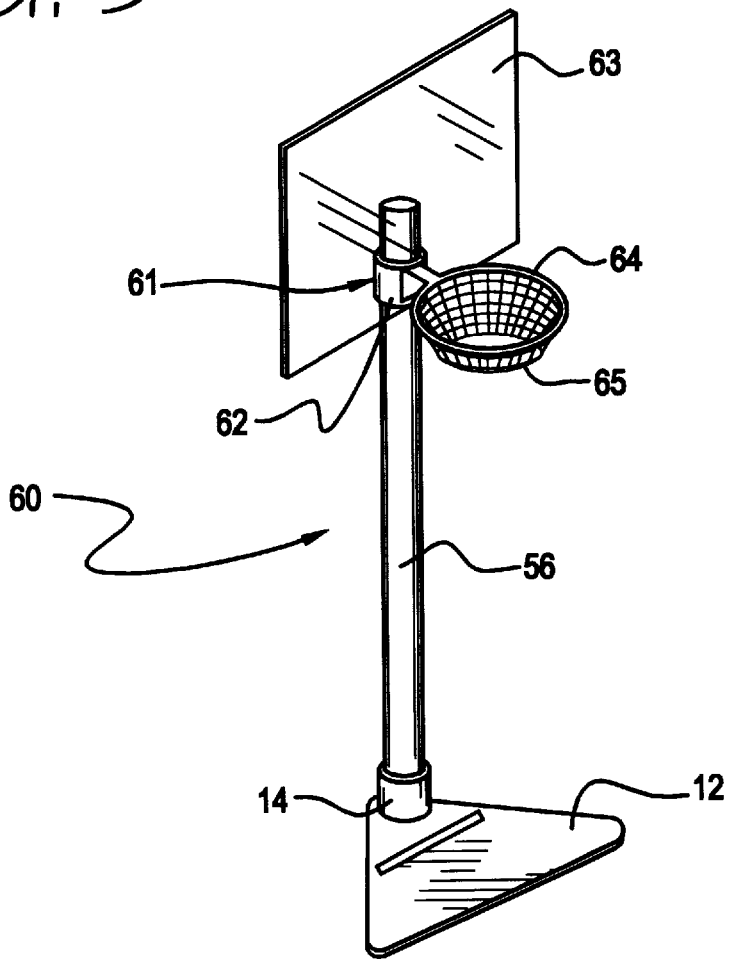
FIG. 4 illustrates a basketball goal constructed in accordance with the present invention.

FIG. 4 shows a basketball goal 60. The basketball goal 60 uses the same base 12 as used for the football goal, and includes integral retainer 14. A flexible post 56 is inserted into retainer 14. The tapered interior surface of retainer 14 grips the inserted flexible post 56, in the same manner as shown in FIG. 5 for retainer 14 gripping flexible post 16. The flexible post 56 can be made of foam rubber.

An article 61 having a transparent backboard 63 and having a gripper 62 on one end and a basketball hoop 64 on the other end is slid onto the flexible post 56. The interior surface of gripper 62 is tapered in the same manner as shown in FIG. 6 for gripper 22. The result is that the article 61 is held in position on the flexible post 62. The article 61 can be made of plastic. The transparent backboard 63 can be made of clear plastic or Plexiglas. A net 65 can be placed onto the basketball hoop 64.

The described embodiments of the invention are only considered to be preferred and illustrative of the inventive concept, the scope of the invention is not to be restricted to such embodiments. Various and numerous other arrangements may be devised by one skilled in the art without departing from the spirit and scope of this invention.

It is therefore intended by the appended claims to cover any and all such applications, modifications and embodiments within the scope of the present invention.

What is claimed is:

1. A goal for a game comprising:

a base;

a retention means for retaining a flexible pole coupled to the base;

a first flexible pole inserted into the retention means;

wherein the retention means comprises a cylindrical wall attached to and rising from the base;

a crosspiece having a first end, a second end, and having a center;

a first gripper on the first end of the crosspiece, the first gripper having a first opening having an entry side and an exit side and adapted for retaining an inserted flexible pole;

a second gripper on the second end of the crosspiece, the second gripper having a second opening having an entry side and an exit side and adapted for retaining an inserted flexible pole;

a center gripper means for retaining a flexible pole on the center of the crosspiece, the center gripper means having a hole having an entry side, the hole extending to a bottom wall and the hole adapted for retaining an inserted flexible pole;

the first flexible pole inserted into the hole in the center gripper means;

a second flexible pole inserted into the first opening so that the second flexible pole extends away from the base; and a third flexible pole inserted into the second opening so that the third flexible pole extends away from the base.

2. The goal for a game of claim 1 wherein:

the first opening comprises a conically tapered opening to retain the second flexible pole; and the second opening comprises a conically tapered opening to retain the third flexible pole.

3. The goal for a game of claim 1 wherein the base comprises:

a flat plate extending in front of the retention means, the flat plate adapted to be positioned under a playing field; and a second plate extending to the rear of the retention means and beyond the playing field.

4. The goal for a game of claim 3 wherein:

the cylindrical wall comprises a conically tapered opening to retain the inserted first flexible pole.

* * * * *